United States Patent [19]

Barbour

[11] Patent Number: 4,459,912

[45] Date of Patent: Jul. 17, 1984

[54] PRINTING PRESSURE COMPENSATING MEANS IN PUMP HANDLE IMPRINTERS

[75] Inventor: William P. Barbour, Columbia, Md.

[73] Assignee: DBS, Inc., Randolph, Mass.

[21] Appl. No.: 402,431

[22] Filed: Jul. 28, 1982

[51] Int. Cl.[3] ..... B41F 3/04

[52] U.S. Cl. ..... 101/269

[58] Field of Search ..... 101/269, 56, 298, 376, 101/379, 126; 100/163 R, 169, 234, 233; 16/225, DIG. 33

[56] References Cited

U.S. PATENT DOCUMENTS

| | | | |
|---|---|---|---|
| 1,920,466 | 8/1933 | Haskins et al. | 16/DIG. 33 |
| 2,620,729 | 12/1952 | Gilbert | 101/269 |
| 2,778,304 | 1/1957 | Juhas | 101/298 |
| 3,090,303 | 5/1963 | Manners et al. | 101/269 |
| 3,188,949 | 6/1965 | Hill | 101/56 |
| 3,363,550 | 1/1968 | Kruger | 101/269 |
| 3,377,949 | 4/1968 | Prince | 101/376 X |
| 4,338,860 | 7/1982 | Hamu | 101/126 |

*Primary Examiner*—Edgar S. Burr
*Assistant Examiner*—John A. Weresh
*Attorney, Agent, or Firm*—Gerald J. Ferguson, Jr.; Joseph J. Baker

[57] ABSTRACT

A data recorder is provided comprising an anvil for supporting an embossed card and a form to be imprinted, a print head supported on a pivot means for movement between an open position and a closed position, and a roller platen movable across the anvil to perform a printing stroke. The anvil is mounted on a resilient pad and the pivot means is mounted in resilient bushing. In response to printing pressure applied by the roller platen in its movement through a printing stroke, the resilient mountings allow for movement of the anvil and the roller platen to adjust the pressure and compensate for the combined variations in the thicknesses of the form and the embossed card.

8 Claims, 3 Drawing Figures

FIG. 1
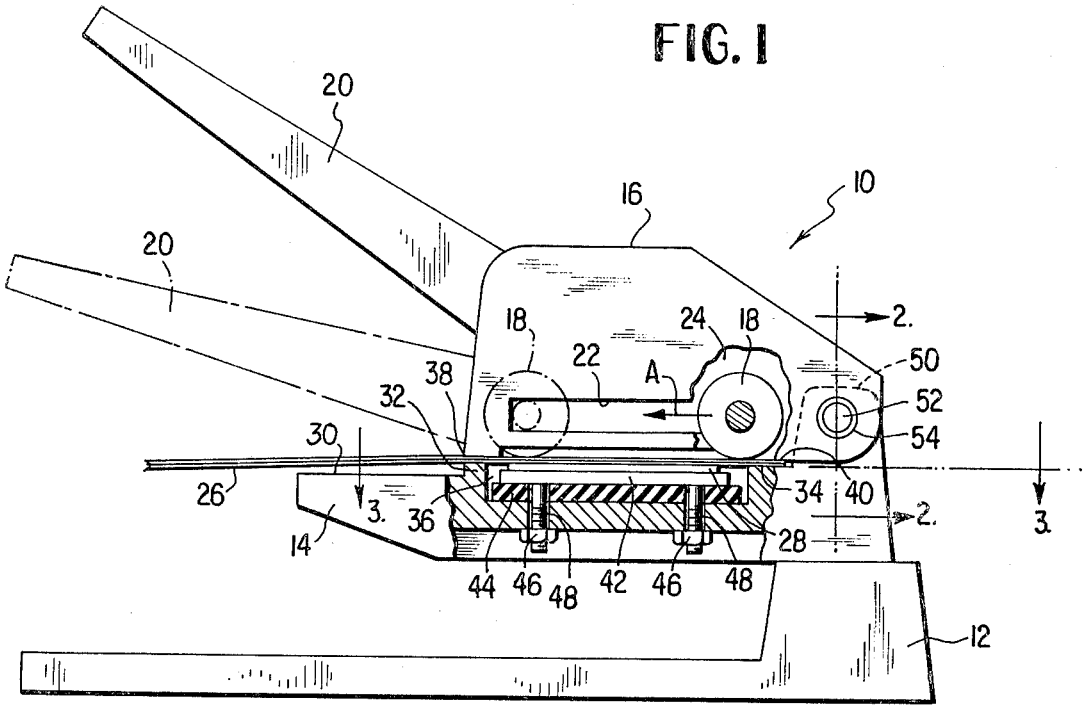
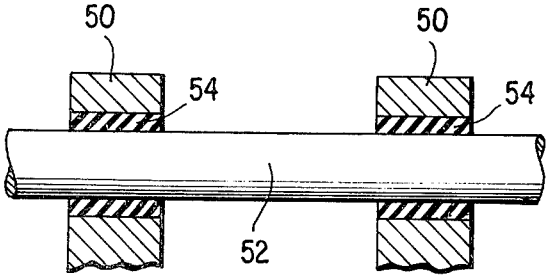
FIG. 2
FIG. 3
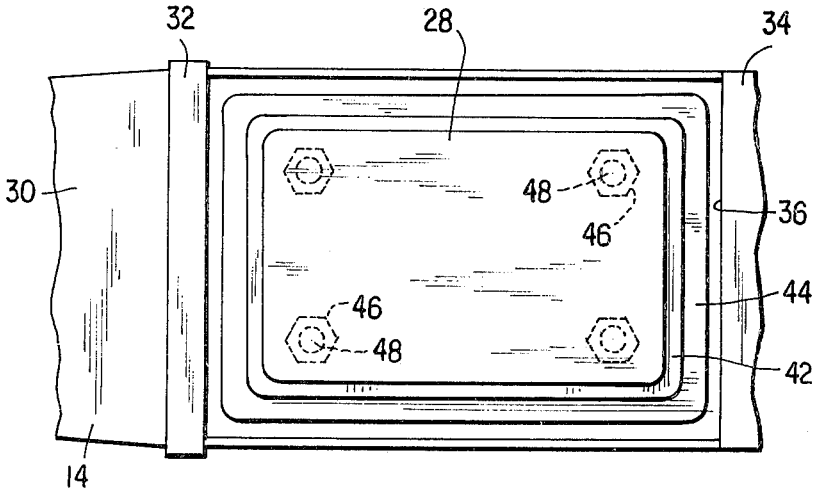

PRINTING PRESSURE COMPENSATING MEANS IN PUMP HANDLE IMPRINTERS

BACKGROUND OF THE INVENTION

A data recorder is provided comprising an anvil for supporting an embossed card and a form to be imprinted, a print head supported on a pivot means for movement between an open position and a closed position, and a roller platen movable across the anvil to perform a printing stroke. The anvil is mounted on a resilient pad and the pivot means is mounted in a resilient bushing. In response to printing pressure applied by the roller platen in its movement through a printing stroke, the resilient mountings allow for movement of the anvil and the roller platen to adjust the pressure and compensate for the combined variations in the thicknesses of the form and the embossed card.

Although present day data recorders are well suited to imprinting documents in a legible, accurate manner, it has been found that a wide variety of data recorders are required in order to meet the requirements of the many different applications. One of the major difficulties in attempting to provide a standardized data recorder for use in various applications is the variations in form and/or embossed card thicknesses.

It will be appreciated, in recording certain types of business transactions numerous copies are required for inventory and other bookkeeping purposes. These copies can represent a substantial thickness especially in view of interleaved carbon paper sheets where these are present, together with tabulating card and an opaque or bond top sheet. In other instances, fewer copies are required so that the thickness of the form set may vary. Moreover, the thickness of the card and the height of the embossed characters afforded by the card may also vary. Accordingly, it is necessary to adjust the roller platen to a selected printing position spaced from the bed of the data recorder for different thicknesses of forms and cards in order to obtain dense, clear and legible printed impressions.

For many years it was acceptable practice to adjust the machines to accept one thickness of embossed card and a particular thickness of form set. However, more recently retail outlets are honoring credit cards which vary in total embossure height by as much as 0.012 inch for imprinting form sets which range in thickness from 0.005 to 0.024 inch. While the form sets imprinted on data recorders of this type are not intended for optical character recognition or other types of machine scanning, it is necessary to produce carbon impressions on the form set which are clear, legible and easily read by the human eye.

Various approaches have been taken to construct a data recorder in such manner that clear and legible impressions can be obtained on copies regardless of the various thicknesses of the form sets and the embossed cards. Some of these prior art devices utilize a compensating anvil which is spring loaded to permit movement of the anvil away from the roller platen as a result of the printing operation. However, this arrangement can provide only a limited amount of compensation.

Other devices provide a compensating platen such that the axis of rotation of the platen can be adjusted to accommodate different thicknesses of form sets to be imprinted. In this case, it is necessary to manually adjust the platen for each different thickness range of form sets and embossed cards.

Still other compensating arrangements are shown in U.S. Pat. Nos. 3,277,822 and 3,795,191 assigned to the same assignee as the present invention.

The data recorder of the present invention is of the kind commonly referred to in the trade as a "pump handle" data recorder, since it includes a handle which is pumped or actuated from a raised to a lowered position for moving the roller platen from a home position through a printing stroke, and returned from the lowered to the raised position to restore the platen to the home position.

A data recorder of the foregoing kind comprises a print head mounted for pivotal movement between an open position for placement of the embossed card and the form set on a bed of the machine, and a closed position against the bed to perform a printing operation by actuating the handle and moving the platen across the form set. However, because of the variations in form set and card thicknesses, conventional data recorders of the foregoing type are unable to compensate for the different thicknesses and, therefore, are unable to successfully imprint clear and legible impressions from a variety of form and card thicknesses. Additionally, in some instances actual breakage of the data recorder could result in view of excessive form set and embossed card thicknesses and extensive leverage embodied in the nutcracker-like design provided by the pump handle.

SUMMARY OF THE INVENTION

The present invention provides a compensating means for a data recorder and, more specifically, a compensating means for automatically adjusting the anvil and the roller platen pressure to compensate for the differences in form set and embossed card thicknesses without increasing the printing pressure.

The data recorder comprises a base including a bed for supporting an anvil, a print head mounted on the base for pivotal movement between an open and a closed position, roller platen supported on the print head and a pump handle for moving the roller platen from a home position across the anvil to perform a printing stroke. The embossed card is supported on the anvil and a form set to be imprinted is positioned in superposed relation with the embossed card.

To provide for compensation of the anvil, the anvil is mounted on a resilient or compliant pad mounted on the bed and underlying the anvil. Thus, in response to the roller platen applying printing pressure to the form set in its movement through a printing stroke, the anvil is allowed to move downwardly or away from the roller platen by compressing the resilient pad. The amount of movement of the anvil is dependent upon the combined thickness of the form set and the embossed card.

In addition to resiliently mounting the anvil, the data recorder also provides for resiliently mounting the print head by providing a resilient bushing or sleeve at the pivot means of the print head. This arrangement allows the print head and, of course, the roller platen carried by the print head to move upwardly or away from the anvil by the pivot means acting against the resilient bushing. Thus, in response to movement of the roller platen through a printing stroke, and depending on the thickness of the form set and embossed card on the bed, the roller platen and the anvil are movable away from each other through compression of the resilient pad and the bushings to thereby compensate for the difference in combined thickness without increasing the printing pressure.

The foregoing arrangement of the resilient pad associated with the anvil and the resilient bushings associated with the pivot means also serves to maintain the roller platen in parallel relation with the printing area, and substantially eliminates the risk of damaging the data recorder as a result of attempting to perform a printing operation with a form set and embossed card having a combined thickness greater than that for which the machine is adjusted.

It is an object of the invention to provide an improved compensating means in a data recorder for automatically adjusting the anvil and the roller platen pressures to compensate for the combined variations in forms set and embossed card thicknesses.

Another object is to provide a resilient member in association with the anvil and a resilient means in association with the pivot means of the print head to allow for movement of the anvil and the roller platen in response to printing pressure by compression of the resilient elements.

Another object of the invention is to provide a pump handle type data recorder with a resiliently mounted anvil and a resiliently mounted pivot for the print head, thereby allowing movement of the anvil and the platen in opposite direcitons to compensate for varying form and card thicknesses without increasing printing pressure during a printing operation.

A feature of the invention is to provide a compensating means for a data recorder which is simple in construction, economical to produce and reliable in operation.

Other objects, features and advantages of the invention will appear hereinafter as the description proceeds.

IN THE DRAWING

FIG. 1 is a side elevation of a data recorder, partially in section, showing a compensating means in accordance with the present invention;

FIG. 2 is a section taken on the line 2—2 in FIG. 1; and

FIG. 3 is a section taken on the line 3—3 in FIG. 1.

DESCRIPTION OF THE PREFERRED EMBODIMENT

The data recorder is shown generally by the reference numeral 10 and includes a support 12, a base 14 fixed on the support and a print head 16 pivotally mounted on the base. A roller platen 18 is rotatably mounted in the print head 16 and, through suitable linkage and biasing means not shown in the drawing, is adapted to be moved through a printing stroke in response to actuation of a handle 20.

The roller platen 18 is shown in full lines in FIG. 1 in a home position and is movable in the direction of arrow A, guided in slots 22 provided in side walls 24 of the print head 16, in response to manual actuation of the handle 20 from the full line to the phantom line position. This movement of the roller platen 18 is effective to imprint a form set 26 positioned on the base 14 in overlying relation with a printing device or embossed card 28. In response to release and return of the handle 20 from the phantom to the full line position, the roller platen 18 is also restored to its home position.

As shown in FIGS. 1 and 3, the base 14 comprises a bed 30 provided with raised surfaces 32 and 34 and a well or recessed portion 36. The raised sufaces 32 and 34 coact with the print head 16 at points 38 and 40 to pinch or clamp the form set 26 to hold it in place and against movement during a printing operation. The well 36 houses an anvil 42 for supporting the embossed card 28 with the embossures on the card 28 facing upwardly and in contact with the underside of the form set 26.

To provide for compensation of the printing pressure of the anvil 42 in regard to the thickness of the form set 26 and the embossed card 28, and as shown in FIGS. 1 and 3, the anvil 42 is supported on a resilient or compliant pad 44 of urethane, rubber or the like. By mounting the anvil 42 so that it is biased upwardly by the resilient pad 44, and constrained by nuts 46 acting on studs 48 to obtain initial height setting of the anvil 42, and by providing a resilient means in association with a pivot mount or member 52 of the print head 16 as will be described hereinafter, the roller platen 18 is maintained in parallel relationship to the printing area of the form set 26 and embossed card 28 in the movement of the roller platen through a printing stroke.

With reference to FIGS. 1 and 2, the base 14 is provided at one end thereof with a pair of upstanding support members 50. The support members 50 mount the pivot member 52 for hinging the print head 16 to the base 14 for pivotal movement between an open position spaced from the bed 30 and a closed position against the bed 30 as shown in the drawing. To provide for compensation of the printing pressure of the roller platen 18 in regard to the thickness of the form set 26 and the embossed card 28, the pivot member 52 is supported in resilient bushings or sleeves 54 provided in each of the support members 50 as best shown in FIG. 2.

With reference to FIG. 1, as the thickness of the form set 26 is increased at the point 38 where the form set 26 is clamped, it adversely affects the path on which the roller platen 18 travels through a printing stroke. Thus, the path is changed from one which is parallel to the anvil 42 to a path which is angularly disposed in respect of the anvil 42 and undesirable for quality imprinted impressions.

However, by mounting the anvil 42 on the resilient pad 44, and providing the resilient bushings 54 on the pivot member 52 of the print head 16, the two resilient means 44 and 54 acting in concert cooperate to maintain the roller platen 18 in parallel relation during its travel across the form set 26 and the embossed card 28 to perform a printing operation.

Additionally, the resilient pivot or hinge provided by the resilient bushings 54 allows the pivot member 54 to biased upwardly or away from the bed 30 as thicker form sets 26 are clamped at point 38, thereby alleviating the possibility of damaging the data recorder as a result of attempting to imprint a form set in which the combined thickness of the form set and the embossed card is greater than range of thickness the data recorder can accommodate. Thus, the resilient mountings of the anvil 42 and the pivot member 54 provide improved print quality of form sets and embossed cards of varying thicknesses, and also eliminated undue pressures exerted on the pivot member 52 during a printing operation.

In the operation of the data recorder 10, the print head 16 is moved to the open position by grasping and moving the handle 20 in a clockwise direction. The embossed card 28 is placed on the anvil 42 and the form set 26 is placed over the card and rests on points 32 and 34 of the bed 30.

The handle 20 is now rotated in the opposite direction to pivot the print head 16 to the closed position against the bed 30, and further rotation of the handle 20 to the phantom line position show in FIG. 1 drives the roller platen 18 from the home position across the form set and the card 28 to the phantoms line position to perform a printing stroke. The handle 20 is then released and returned to the full line position, and then further lifted to pivot the print head to the open position to permit removal of the form set and the embossed card from the bed 30.

During the travel of the roller platen 18 through a printing stroke, the printing pressure exerted by the anvil 42 compressed the resilient pad 44 thereby allowing the anvil to move downwardly against the bias of the resilient pad. Similarly, the printing pressure exerted by the roller platen 18 compressed the resilient bushings 54 thereby allowing the roller platen to move upwardly or away from the anvil. This arrangement provides for automatic adjustment of the anvil and the roller platen pressure due to the combined variations in form set and embossed card thicknesses without increasing the printing pressure.

From the foregoing, it will be appreciated that the present invention provides a compensating means for a data recorder for automatically adjusting the printing pressure relative to the thicknesses of the form set and the embossed card which is simple in construction and economical to produce. The invention may be incorporated in existing data recorders with only minor modifications, and provides a reliable arrangement for obtaining quality impressions from varying thickness form sets and cards, while preventing damage to the data recorder as a result of attempting to imprint from excessively thick form sets and embossed cards.

Although specific mechanisms and conditions are set forth in the above description, these are merely illustrative of the present invention. Other modifications and/or additions will readily occur to those skilled in the art upon reading the disclosure and these are intended to be encompassed within the spirit of the invention.

What is claimed is:

1. A data recorder for imprinting forms by means of printing devices in which forms and printing devices of various thicknesses may be accepted, comprising:

a bed;

an anvil on the bed for supporting a form set in overlying relationship with a printing device;

a print head supporting a roller platen for movement across the bed to perform a printing stroke;

pivot means on the bed for mounting the print head for pivotal movement between an open position spaced from the bed and a closed printing position against the bed;

means for moving the roller platen through a printing stroke in printing pressure engagement with the form set and the printing device;

first resilient means for biasing the anvil towards the form set and compressible by the anvil in response to the printing pressure; and resilient bushing means compressible by the pivot means for biasing the roller platen in a direction away from the anvil in response to the printing pressure, whereby the first resilient means and the resilient bushing means provide for automatic adjustment of the anvil and the roller platen pressure respectively, to compensate for the combined variations in form set and printing device thicknesses without increasing the printing pressure.

2. A data recorder as set forth in claim 1 in which the means for moving the roller platen comprises a pump handle operatively associated with the roller platen actuable from a first to a second position for moving the roller platen from a home position through a printing stroke, and actuable from the second to the first position for moving the roller platen back to the home position.

3. A data recorder as set forth in claim 1 further comprising; means on the bed adapted to coact with the print head when the print head is in the closed position for clamping the form set against movement on the bed during movement of the roller platen through a printing stroke.

4. A data recorder as set forth in claim 1 in which the first resilient means comprises a pad of compliant material secured to the bed in underlying relation with the anvil.

5. A data recorder as set forth in claim 4 in which the compliant pad is made of urethane.

6. A data recorder as set forth in claim 4 in which the compliant pad is made of rubber.

7. A data recorder as set forth in claim 1 in which the resilient bushing means is made of urethane.

8. A data recorder as set forth in claim 1 in which the resilient bushing means is made of rubber.

* * * * *